US010118219B2

(12) United States Patent
Itamura et al.

(10) Patent No.: US 10,118,219 B2
(45) Date of Patent: Nov. 6, 2018

(54) SEMISOLID CASTING/FORGING APPARATUS AND METHOD AS WELL AS A CAST AND FORGED PRODUCT

(71) Applicant: TOHOKU UNIVERSITY, Miyagi (JP)

(72) Inventors: Masayuki Itamura, Miyagi (JP); Kouichi Anzai, Miyagi (JP)

(73) Assignee: TOHOKU UNIVERSITY, Sendai-Shi (JP)

( * ) Notice: Subject to any disclaimer, the term of this patent is extended or adjusted under 35 U.S.C. 154(b) by 182 days.

(21) Appl. No.: 15/022,119

(22) PCT Filed: Oct. 9, 2014

(86) PCT No.: PCT/JP2014/077106
§ 371 (c)(1),
(2) Date: Apr. 22, 2016

(87) PCT Pub. No.: WO2015/053373
PCT Pub. Date: Apr. 16, 2015

(65) Prior Publication Data

US 2016/0228946 A1 Aug. 11, 2016

(30) Foreign Application Priority Data

Oct. 9, 2013 (JP) ..... 2013-212386

(51) Int. Cl.

| | |
|---|---|
| ***B22D 18/02*** | (2006.01) |
| ***B22D 27/04*** | (2006.01) |
| ***B22D 17/00*** | (2006.01) |
| ***B22D 17/22*** | (2006.01) |
| ***B22D 27/11*** | (2006.01) |
| ***B22D 19/00*** | (2006.01) |
| ***B22D 19/04*** | (2006.01) |

(52) U.S. Cl.
CPC ..... *B22D 18/02* (2013.01); *B22D 17/007* (2013.01); *B22D 17/229* (2013.01); *B22D 19/00* (2013.01); *B22D 19/04* (2013.01); *B22D 27/04* (2013.01); *B22D 27/11* (2013.01)

(58) Field of Classification Search
CPC .... B22D 18/02; B22D 17/007; B22D 17/229; B22D 19/00; B22D 19/04; B22D 27/04; B22D 27/11
USPC ..... 428/402
See application file for complete search history.

(56) References Cited

U.S. PATENT DOCUMENTS

| | | | | |
|---|---|---|---|---|
| 6,742,567 | B2 * | 6/2004 | Winterbottom ..... | B22D 17/007 164/113 |
| 9,038,705 | B2 * | 5/2015 | Itamura ..... | B22D 17/007 164/113 |
| 2003/0037900 | A1 * | 2/2003 | Winterbottom ..... | B22D 17/007 164/113 |
| 2004/0211542 | A1 | 10/2004 | Winterbottom et al. | |
| 2005/0000604 | A1 * | 1/2005 | Kawahara ..... | B22D 21/007 148/440 |
| 2015/0240337 | A1 * | 8/2015 | Sherman ..... | B22D 19/14 420/408 |
| 2016/0250684 | A1 | 9/2016 | Itamura et al. | |

FOREIGN PATENT DOCUMENTS

| | | | |
|---|---|---|---|
| JP | 56-50771 | | 5/1981 |
| JP | 63-299845 | | 12/1988 |
| JP | 04-89171 | | 3/1992 |
| JP | 04-138863 | | 5/1992 |
| JP | 6-210422 | * | 8/1994 |
| JP | 06-210422 | | 8/1994 |
| JP | 06-346075 | | 12/1994 |
| JP | 07-214281 | | 8/1995 |
| JP | 7-246453 | | 9/1995 |
| JP | 9-135930 | | 5/1997 |
| JP | 2000-042718 | | 2/2000 |
| JP | 2001-252754 | | 9/2001 |
| JP | 2003-136223 | * | 5/2003 |
| JP | 2004-538153 | * | 12/2004 |
| JP | 2010-77465 | | 4/2010 |
| WO | 2013/039247 | | 3/2013 |

OTHER PUBLICATIONS

International Search Report, PCT/JP2014/077106, dated Jan. 27, 2015.

* cited by examiner

*Primary Examiner* — Leszek B Kiliman
(74) *Attorney, Agent, or Firm* — Young & Thompson

(57) ABSTRACT

An excellent cast and forged product that is superior in mechanical properties and has a microstructure and which may not only be a thin but also be a thick product can be made without using complicated process steps or equipment. A semisolid casting and forging method is provided in which a metal melt is teemed so that it is supercooled into a lower die in a press so controlled that the metal melt has a rate of solidification as desired, thereby preparing a semisolid slurry; an upper die is brought into contact with the semisolid slurry; and thereafter at least one of the upper and lower dies is moved relatively towards the other at a rate of movement between 0.1 and 1.5 m/sec, thereby compressing the semisolid slurry to mold it into a product. The semisolid slurry preferably has crystal grains of a grain size of 50 μm or less.

9 Claims, 6 Drawing Sheets

Metallographic Structure of
Semisold Cast and Forged Product (Connecting Rod)

Changes in Temp. in the Mold; Influences by Teeming Temp.

SEMISOLID CASTING/FORGING APPARATUS AND METHOD AS WELL AS A CAST AND FORGED PRODUCT

TECHNICAL FIELD

The present invention relates to a semisolid casting and forging apparatus and method as well as a cast and forged product.

BACKGROUND ART

For example, as a social need being imposed on automobiles, an improvement is intensively required in fuel economy. This is effectively to be achieved by light-weighting. To the end, while aluminum and plastic materials have been being adopted, strength and precision tend to be incompatible to attain, thus becoming an acute technological problem. Also, while with an uprush of eco-consciousness in recent years, the bicycle industry proves active, enhanced light-weighting and also rises in strength and other mechanical properties and improvements in sense of quality are here, too, sought to differentiate products, giving rise to the foregoing problem. And, in the fields of electronic devices and others as well, enhanced light-weighting and rises in strength and other mechanical properties and improvements in sense of quality are being asked for.

As a technology to achieve light-weighting (i.e. thinning) and to improve strength and other mechanical properties, a semisolid casting technique is presently known.

The semisolid casting technique includes rheocasting and thixocasting methods.

Rheocasting is a method which comprises cooling an alloy from its liquid state while it is being agitated to grow primary crystal in the form of particles, followed by molding it when a certain rate of its solidification is reached. It is also called semisolid die-casting.

In the thixocasting method on the other hand which is also called semi-melt casting, an alloy molten is once solidified while it is being agitated to form a billet which then, when cast, is heated again to form a body in a solid and liquid coexisting state, the body being then molded.

The thixocasting method has a problem that a special billet of which the structure is adjusted is expensive. It has also a problem that it lacks energy saving since a billet is re-molten to form a semi-metal slurry for casting. Furthermore, the thixocasting method has a problem that a material that is once cast thereby cannot be re-molten for use and cannot be recycled. Hence, the rheocasting method is presently the mainstream.

There is a process in which after crystallization of a given amount of solid phase, a slurry in a solid and liquid coexisting state is teemed or poured into an injection sleeve for injection filling (NRC process: Ube's New Rheocasting Process; see, for example, Patent Reference 1).

The NRC process, however, requires time in forming the semi-solidified slurry, necessitates large and costly equipment and has a limit in micronizing a spherical crystal due to an insufficient number of occurrences of nucleation.

As a technique to break through the limitation, i.e., as a technique to form a slurry inexpensively, quickly and simply and to increase the number of occurrences of nucleation, there have been proposed a nano-casting process (Patent Reference 2) in which agitation is produced electromagnetically and a cup process (Patent Reference 3) by self-agitation.

Subsequently, problems of micronization of a spherical crystal have been combated to optimally control the temperature of a metal melt when teemed into a sleeve, leading to the development of a semisolid slurry forming process (Patent Reference 4) which without having the conventional slurry forming equipment allows a number of crystalline nuclei to be crystallized in the sleeve and by adequately controlling the crystal growth permits a microfine spherical crystal to grow which could not so far be grown in rheocasting.

In the meanwhile, of melt forging techniques to forge a metal melt in a die, ones using a rheocasting and a thixocasting method have been proposed, as described e.g. in Patent References 5 and 6, respectively.

In the technique described in Patent Reference 5, a massive mixture (billet) in a semisolid state is placed centrally of a lower die heated at a temperature lower than that of the massive mixture. Then, moving an upper die closer to the lower die allows the massive mixture in the semisolid state to be compressed and deformed.

The technique described in Patent Reference 5 has a problem, however, that the mass of a raw material is large compared with that of a product, making it costly. It should be noted here that the "mass of a raw material" refers to the mass of a raw material supplied into the lower die, and that the "mass of a product" ought to mean the mass of portions excluding an excess bur and any other part than the product. Also, both the masses of raw material and product are those at room temperature.

Further, in the case of a product having a thin portion (e.g. a portion of 1 mm or less thick), the thin portion needs to have a flash or an excess thickness added thereto which needs to be cut away subsequently in an additional process step, becoming a cause of making the process costly.

Patent Reference 6 (JP H04-182 054 A) describes a melt forging technique in which a melt of metallic material teemed into a press die is held therein for a fixed period of time in the state that it is under a pre-load, and an additional pressure is applied to at least a portion of the metallic material for a time interval from the start to the end of its solidification until its temperature is reduced to 300° C. to deform it.

However, the technique described in Patent Reference 6 needs to have a plurality of process steps of applying a preload and an additional pressure, rendering the process complex while having no choice but to complicate an apparatus therefor.

Also, Non-patent Reference 1 discloses a technique in which a semisolid slurry formed in a metal container shaped to follow a product shape is cast into a die for compression molding.

While this process allows obtaining a spherical structure, the process requires steps in which a semisolid slurry is once prepared and is then transferred into a die. Furthermore, a mass of raw material is made larger than that of a product, making the technique costly from the aspect of raw materials.

PRIOR ART REFERENCE

Patent References

Patent Reference 1: JP 2003-126 950 A
Patent Reference 2: JP 4 134 310 B
Patent Reference 3: JP 3 919 810 B
Patent Reference 4: WO 2013/039 247 A
Patent Reference 5: JP 2009-235 498 A Patent Reference 6: JP H04-182 054 A Non-Patent References Non-Patent Reference 1: Report of Results of Research and Development "Development of a High-Grade Product for Automobiles by Semisolid Casting & Forging Method" in Projects to Support the Advancement of Strategic Substrate Technologies in Fiscal 2011 3rd Supplemental Budget, March 2013

SUMMARY OF THE INVENTION

Problems to be Solved by the Invention

It is an object of the present invention to provide a semisolid casting and forging method whereby a product that may have a thin thickness portion (portion of a thickness of not more than 1 mm) can be made at an extremely high rate of yield without using complicated process steps or equipment.

Means for Solving the Problems

In accordance with the present invention, there is provided a semisolid melt forging apparatus in which a metal melt or molten metal is teemed or poured into a cavity in a lower die, and at least one of the lower and an upper die is moved relatively towards the other at a rate of relative movement to initiate molding of the metal melt in a semisolid state, the apparatus being adapted to adjust the said rate of relative movement so that a time interval had between an instant at which the metal melt is teemed and an instant at which the molding is initiated ranges between 0.1 second and 10 seconds.

The present invention provides a semisolid melt forging apparatus, wherein the said apparatus is adapted to adjust the said rate of relative movement so that the time interval had between the instant at which the metal melt is teemed and the instant at which the molding is initiated ranges between 0.1 second and 5 seconds.

The present invention provides a semisolid melt forging apparatus, wherein the said upper and lower dies are spaced from each other at a distance between 30 and 50 cm at the instant at which the said metal melt is teemed into the cavity.

The present invention provides a semisolid melt forging apparatus, wherein the said rate of relative movement between the upper and lower dies is variable at least in a range between 0.03 meter and 5 meters per second.

The present invention also provides a semisolid melt forging method in which a metal melt is teemed into a cavity of a lower die, and at least one of the lower and an upper die is moved relatively towards the other at a rate of relative movement to perform molding of the metal melt in a semisolid state, the method comprising the steps of:

preparing from said metal melt teemed a slurry so that it has grains of a grain size of not more than 50 μm formed therein, and initiating the molding at a lapse of time ranging between 0.1 second and 10 seconds following an instant at which the metal melt is teemed.

The present invention provides a semisolid melt forging method, wherein the said rate of relative movement is adjustable so that the said lapse of time had between the instant at which the metal melt is teemed and the instant at which the molding is initiated ranges between 0.1 second and 5 seconds.

The present invention also provides a semisolid casting and forging method, which comprises the steps of:

teeming a metal melt so that it is supercooled into a lower die in a press so controlled that the metal melt has a rate of solidification as desired, thereby preparing a semisolid slurry;

bringing an upper die into contact with the semisolid slurry; and thereafter moving at least one of the upper and lower dies relatively toward the other at a rate of relative movement between 0.1 and 1.5 meter per second at least after an instant at which the upper die comes in contact with the said semisolid slurry, thereby compressing the said semisolid slurry to mold it into a product.

The present invention also provides a semisolid casting and forging method, which comprises the steps of:

teeming a metal melt so that it is supercooled into a lower die in a press so controlled that the metal melt has a rate of solidification as desired, so as to make a semisolid slurry having crystal grains of a grain size such that fluidity of the slurry is rising when it is compressed;

bringing an upper die into contact with the semisolid slurry; and thereafter moving at least one of the upper and lower dies relatively towards the other at a rate of relative movement between 0.1 and 1.5 meter per second at least after an instant at which the upper die comes in contact with the said semisolid slurry, thereby compressing the said semisolid slurry to mold it into a product.

The present invention also provides a semisolid casting and forging method, which comprises the steps of:

teeming a metal melt so that it is supercooled into a lower die in a press so controlled that the metal melt has a rate of solidification as desired, so as to make a semisolid slurry having crystal grains of a grain size of not more than 50 μm;

bringing an upper die into contact with the semisolid slurry; and thereafter moving at least one of the upper and lower dies relatively towards the other at a rate of relative movement between 0.1 and 1.5 meter per second at least after an instant at which the upper die comes in contact with the said semisolid slurry, thereby compressing the said semisolid slurry to mold it into a product.

The present invention provides a semisolid casting and forging method, wherein the metal melt as it is teemed is of a temperature higher by 10 to 30° C. than its liquid phase or liquidus temperature. The present invention provides a semisolid casting and forging method, wherein the metal melt is cooled passing through a liquidus curve at a rate of cooling of not less than 2° C. per second.

The present invention provides a semisolid casting and forging method, wherein the said lower die is of a temperature of 200° C.±100° C.

The present invention provides a semisolid casting and forging method, wherein the said upper die is of a temperature different from that of the said lower die.

The present invention provides a semisolid casting and forging method, wherein the temperature of at least a portion of the said upper die is lower than the temperature of the said lower die.

The present invention provides a semisolid casting and forging method, wherein the ratio of a product mass to a raw material mass is not less than 0.9.

The present invention provides a semisolid casting and forging method, wherein the semisolid slurry has a different member embedded therein so that the product is comprised of a composite material.

The present invention provides a semisolid casting and forging method, wherein the said upper die has a pin rod inserted therein of which an end has a different member removably held and coupled thereto.

The present invention provides a semisolid casting and forging method, wherein the different member is held and coupled to the said pin rod by a magnetic or vacuum chucking force.

The present invention provides a semisolid casting and forging method, using a powdery die release agent as a die release agent.

The present invention also provides a semisolid cast and forged product, having a spheroidized structure of not more than 50 μm in grain size and having in part a forged structure.

The present invention provides a semisolid cast and forged product, wherein it has a different member embedded therein, which is embedded in a metal melt when it is cast and forged from the metal melt.

The present invention provides a semisolid cast and forged product, wherein it has a forged structure in the vicinity of the said different member.

The present invention provides a semisolid cast and forged product, wherein the semisolid cast and forged product is a connecting rod.

The present invention also provides, a semisolid cast and forged product produced by a method.

Description is given infra of the present invention and the findings that have led to making the present invention.

The present invention relates to a melt forging apparatus and in particular to a system for die molding of a metallic material in a semisolid or semi-solidified state.

In a conventional melt forging apparatus, a metal melt or molten metal is teemed or poured into a mold (die) after which the mold is closed and clamped, waiting for the metal melt reaching a solid state. After the solid state is reached, a load as is required is applied to a part or the whole of the body so that a space may not be formed therein due to its shrinkage. The technique differs from conventional molding by forging. To wit, molding to shape is not made here by large forging pressure. The mold or die only needs to have a function as a container for retaining the molten metal until it becomes solidified. Also, while a pressure is applied to a part or the whole in the solid state, an amount of working corresponds to an amount of shrinkage with a limited deformation resistance at the time of working, thus bringing about substantially no work hardening. Thus, in the conventional melt forging apparatus, there is no need to accelerate the rate of movement of a die, and the die has been designed to move slowly.

On the other hand, the technology to mold in a semisolid state includes a technique in which a semisolid billet (slurry) in the form of a cylinder prepared outside of the dies is loaded on a lower die and then an upper die is moved for molding with the dies. In this technique, a slurry has its shape determined when it is prepared out of the dies. To wit, the rate of movement of an upper die is not to impact significantly on the properties of a product. Moreover, it takes a time period of at least several seconds to move the slurry from a position outside of the dies to a position on the lower die and to move the upper die. Thus, the slurry would unavoidably change in property from where it is prepared to where and after it is moved on the lower die.

The present invention resides in a melt forging apparatus in which a metal melt is teemed into a lower die and at least one of the lower and an upper die is moved relative to each other so as to mold the metal melt in a semisolid state.

In accordance with the present invention, a metal melt is teemed into a cavity in the lower die. Hence, a semisolid slurry is formed and made in the cavity of the lower die.

The present invention is characterized by forming a semisolid slurry in the cavity in a lower die, i.e. not forming or making a semisolid slurry outside of the die and not molding in a lower mold, such a slurry made and formed outside of the lower die.

And, the present invention is further characterized in that the product property of a slurry is controlled when the semisolid slurry is being formed in the lower die from the metal melt teemed therein. There has hitherto been no technical concept of controlling the product property of a slurry when the slurry is so formed.

To control the property of a slurry, the temperature at which the slurry is teemed is controlled (to be equal preferably at a temperature of not less by 5° C. to 50° C. than its melting point and more preferably at a temperature of not less by 5° C. to 30° C. than the melting point) or so by controlling the amount and rate of heat extraction from the teeming metal melt so that a degree of supercooling of more than a constant may be had and that the slurry have crystal grains of a grain size ranging not more than 50 μm. With the heat capacity and heat conductivity of dies, the temperature of the lower die and the latent heat of a metal melt taken into account, the end may be designed to achieve. So that self-agitation is created of the teeming metal melt, it is preferred to teem from a height more than a certain height from the cavity base of a lower die. For example, it is preferable that teeming be effected from a height that is twice the height of a space formed by the upper and lower dies as they are brought to a mating position. Alternatively, the teeming height from the base of the lower die is not less than 3.5 times of an average diameter D of the lower die. It should be noted here that the average diameter may be the half (½) power of a product area. The height at which self-agitation is brought about may pre-experimentally be found according to a shape of the product.

Also, the time interval between the instant of teeming and the instant at which molding is initiated changes the grain size of grains, strength and die filling rate in a product.

Conventionally in melt forging, i.e. in die forging in the sense of making up for a shrinkage, there is necessarily a retention time after teeming. According to the present invention, a slurry being controlled of its nature in the lower die, there can be a slurry formed with crystal grains of a grain size not more than 50 μm instantaneously upon teeming. Also, numerous nuclei are contained without ceasing to exist in the slurry in the state.

Thus, molding if initiated within a time period of 0 to 10 seconds after teeming, is performed well with fluidity, permitting a product to be made having crystal grains of a reduced grain size. In an actual apparatus, however, the time period becomes within a range between 0.1 and 10 seconds. In this range, a lapse of time may be selected corresponding to an optimum nature of the slurry to initiate the die molding.

In the References referred to previously, mention is made of semisolid casting and forging (using rheocasting) and semi-molten casting and forging (using thixocasting) but there is no disclosure at all of any implementation of a related technique. In particular, there is no hint of a melt temperature and any other specific conditions and no clarification of how a method is to be performed. It is noted that a technique of interest is left uncertain and, let alone, undeveloped.

The present inventors, having undertaken to search for specific conditions in semisolid casting and forging, have found that depending upon conditions of a semisolid slurry, and in turn conditions for its preparation in a die, even reducing much the mass of a raw material may yield a product excellent and having no underfill.

Its reproducibility remained unsatisfactory, however. Then, upon repeating further experiments, it has been revealed that controlling not only the preparatory conditions but also the forging conditions of a semisolid slurry makes it possible to reproducibly realize a good product.

To wit, a semisolid slurry is made in accordance with the present invention by teeming a metal melt so that it may be supercooled into a lower die in a press so controlled that the metal melt may be solidified at a rate of solidification as desired. For example, by controlling the degree of supercooling, the number of nuclei created and in turn the grain size of crystalline particles (e.g. of primary crystal) in the semisolid slurry can be controlled.

In order to cause overcooling to occur that forms a semisolid slurry in which crystal grains of a grain size not more than 50 μm are evenly distributed, it is preferred, for example, that the metal melt have a temperature higher by 10 to 30° C. than its liquid phase temperature. A temperature difference less than 10° C. may cause it to commence solidifying before nuclei are created therein. Exceeding 30° C. may cause the nuclei created to cease to exist. It should be noted here that since the degree of supercooling can be controlled, e.g. by adjusting the temperature of the lower die, it is possible to form a semisolid slurry having crystal grains of a grain size not more than 30 μm and not more than 10 μm, which is further finer than 50 μm or less. The lower the temperature of the lower die, the more liable is the supercooling to occur. Thus, for actual production, experiments in which varied temperatures of the lower die are used are made to establish an adjustable grain size of crystal grains in a slurry.

The rate of cooling where a liquidus curve is passed through is preferably not less than 2° C./s and more preferably not less than 20° C./s. With a teeming metal melt cooled at a rate of 2° C. or more, a difference in temperature between its surface and inside will shortly be lost, rendering its entirety even in temperature in a short period of time. This is deemed to cause nuclei to be created in even distribution and distributed more entirely in the slurry.

The present inventors have experimentally confirmed the foregoing finding.

To wit, the temperature at which a metal melt is teemed was varied, as shown in the graphs of FIG. 9, from 720° C. through 660° C. to 640° C., forming a semisolid slurry. With the temperature of 640° C., it is shown that the slurry entirely became more even in temperature and more shortly.

In passing, note that the experiments whose results are shown in FIG. 9 were made using AC4CH.

In the method of the present invention as described above, a semisolid slurry is made by controllably teeming a metal melt so as to cause supercooling to occur therein. A semisolid slurry, that has less variation in temperature distribution, allows nuclei to be created and distributed evenly. Consequently, there are evenly and densely distributed microfine crystal grains (of a primary crystal).

In producing a product having a thin portion, a melt flowing in a liquid state tends to be locally solidified due to surface tension so that a portion of solidification acting as a stopper to flow can hardly fill the thin portion. In contrast, a semisolid slurry is used in accordance with the present invention, having crystal grains as microfine as of a grain size not more than 50 μm and distributed throughout the slurry. These grains is presumed to roll while moving, thus making it less liable to solidify locally. As a result, a thin portion if present is filled. This eliminates the need to provide an excess amount of material, becoming a saving not only of the material but also of a likely additional process step of cutting the excessive portion.

The present inventors undertook experiments on making such semisolid slurries and found there to be ones in which a thin portion might not necessarily be filled up. The grain side of crystal grains was measured in the experiments by taking an average of lengths along their minor and major axes.

The present inventors after repeating further experiments have found that the rate of compressing that can be varied is influential. The rate of pressing in terms of the rate of movement of a movable (upper) die towards a fixed (lower) die is thus varied. It has been found that when a semisolid slurry is compressed at a pressing or movement rate of 0.1 to 1.5 m/s, a thin portion if present in a product can be filled up, and the invention made has been arrived at.

Important in the rate of pressing or compression exerted by an upper die is that it is after the die comes in contact with a semisolid slurry in a lower die that the pressing rate so exerted ranges between 0.1 and 1.5 m/s. While in a time interval from the instant at which the upper die starts moving to the instant at which it comes contact with the semisolid slurry, the die moves through the space without resistance, thereafter the die receives resistance from the semisolid slurry and its rate of movement tends to be lowered. Especially the higher the rate of solidification is so the movement rate. It is thus necessary that the rate of pressing by or movement of the upper die after it comes into contact with the semisolid slurry should rage not less than 0.1 m/s.

It may be noted that since it is preferred that the time interval between the instant at which the die starts moving and the instant at which it comes into contact with the semisolid slurry be short, the rate of movement in the time interval, too, should preferably range between 0.1 and 1.5 m/s.

After the upper die is brought into contact with a semisolid slurry having crystal grains of a grain size not more than 50 μm to commence compression under pressure, accelerating the rate of movement (i.e. pressing rate) lowers the apparent viscosity of the semisolid slurry. Such a drop in the apparent viscosity occurs only with microfine crystal grains having a grain size of 50 μm. This is presumed to be as if it is right that because of a rise of the rate of shear by accelerating the pressing rate, in a semisolid slurry the phenomenon occurs here that the viscosity lowers gradually when the rate of shear given a liquid specimen in a thixotropic state is raised. As a result, the fluidity is ensured even of a semisolid slurry of high rate of solidification.

Eventually, in the present invention, in addition to having microfine grains formed in a semisolid slurry and reducing its viscosity, increasing the pressing rate makes it possible to cause a further lowering of the viscosity and in turn a rise in the liquidity, thus having made it possible to mold a product well even with a thin part. Especially, a marked molding effect that forming is enabled even with a ratio, nearly of 90%, in mass of product to raw material is presumed to be caused by such a conspicuous drop in the viscosity.

When the pressing rate is less than 0.1 m/s, the viscosity is not lowered appreciably even if crystal grains have a grain size of 50 μm, and hence the ratio in mass of product to raw material is not necessarily good. Let the pressing rate thus be not less than 0.1% and, from the standpoint of lowering the viscosity, be preferably not less than 0.5%. In excess of 1.5 m/s, the effect above is saturated and there is a risk of impact on the die. Hence, let the pressing speed be not more than 1.5 m/s.

Generally, the higher the rate of solidification, of a slurry, the greater its viscosity. When a certain value of the rate is exceeded, what has been the slurry flows no longer. This value is termed as "critical (flow limit) rate of solidification rate". It differs with materials. In the prior art, there has hitherto been none in which an aluminum alloy is done with 80%. In accordance with the present invention, the grain size is reduced to not more than 50 μm and the pressing rate is increased to not less than 0.1 m/s, permitting the apparent viscosity of a semisolid slurry to be lowered. Accordingly, the critical rate of solidification is increased and it has been made possible to use a semisolid slurry having a high rate of solidification.

A portion which upon coming in contact with a die surface has started solidifying may become a forged structure as with a worked structure by plastic deformation. It is thus made possible to obtain a product having both cast and forged structures.

A rate of solidification may be determined according to a product structure as desired. For example, it is suitably determined in a range of 20 to 90%.

The temperature of a lower die is preferably 200° C.±100° C.

From the heat capacity of a lower die (varying with volume and material), a temperature is suitably adjusted so that a heat balance (thermal equilibrium) to be described later may be taken.

It should be noted here that the temperatures of an upper and a lower die may be set up different from each other to adjust the metallographic structure of a product suitably corresponding to the other conditions.

The temperature of a part or the whole of an upper die can be set to be lower than that of a lower die. For example, if a large amount of heat is extracted from the lower die, setting the temperature of the upper die to be lower than that of the lower die allows heat to be extracted from the upper die as well, thereby lessening the difference in temperature. Thus, the disadvantage incurred that if there is a difference in temperature between up and down of the semisolid slurry, creation and annihilation of nuclei are made uneven making a product uneven in structure is eliminated.

Conversely, if it is desired to make a difference in property on a selected portion from the other portions, e.g. if it is desired to make a given portion stronger than elsewhere, a part of the upper die which corresponds to the selected portion can selectively be cooled to make that part in solid state selectively. Applying a compression force to the part causes no fluid flow but a plastic deformation thereof, to render it harder or stronger by work hardening. It may be noted here that providing the die inside with a heater or a passage through which a coolant is passed (not shown) facilitates controlling the die temperature.

In making a semisolid slurry, the amount of heat extraction can be adjusted by using a powdery die release agent if the die is large in heat capacity or has a large thermal conductance so that the amount of heat to be extracted is excessive. A powdery die release agent, that is larger in amount of heat extraction than an aqueous die release agent serves better as the thermal resistance. The aqueous die release agent if atomized and sprayed onto the die tends to reduce the temperature of the die, make it difficult to take a thermal balance. In this regard as well, the powdery die release agent is preferred.

Effects of the Invention

According to the present invention, an excellent product which having a microstructure is superior in mechanical property and that may not only be a thin but also be a thick product can be made without using complicated process steps or having any intricate equipment.

DESCRIPTION OF REFERENCE CHARACTERS

Figure 1:
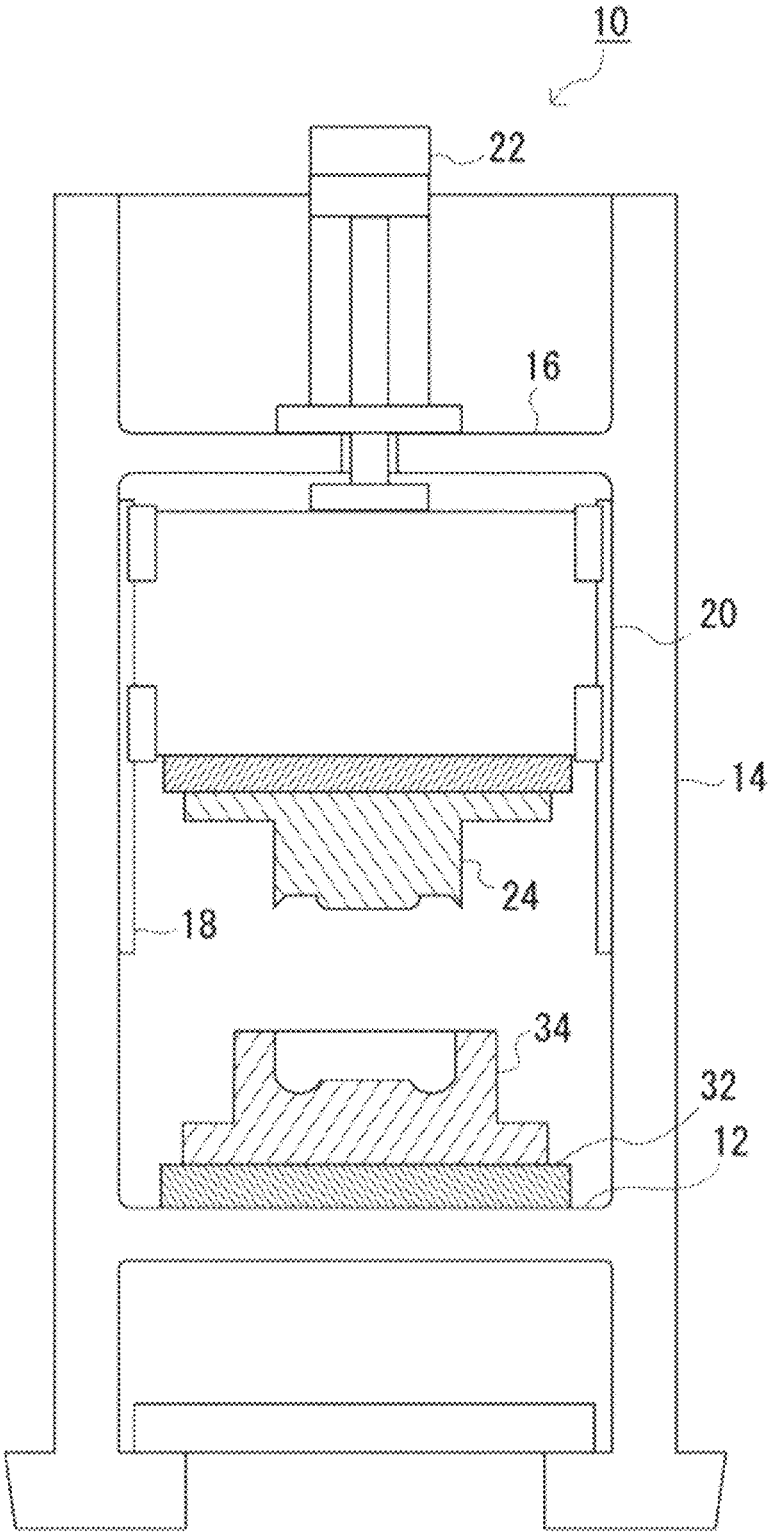
FIG. 1 is a conceptual view illustrating a molding apparatus that can be used to carry out a method of the present invention.

10 molding apparatus
12 bed
14 column
20 slide
24 upper die
32 bolster
34 lower die
50*d* product
51 different member
53 pin rod

Modes for Carrying Out the Invention

FIG. 1 is an entire makeup view that shows one example of molding apparatus to which can be applied a method of forming an aluminum alloy in accordance with the present invention. This apparatus will represent a simplification of the apparatus disclosed in JP 2007-118 030 A.

The molding apparatus shown in FIG. 1 that can, for example, be an oil hydraulic press, has a frame comprising a bed 12, a column 14 and a crown 16, and a slide 20 guided by a guide unit 18 so as to be movable vertically. A first hydraulic cylinder 22 mounted on the crown 16 transmits a driving force to the slide 20 to move it both downwards and upwards as shown in FIG. 1. The slide 20 has its lower end to which is mounted and attached an upper die 24.

On the other hand, a lower die 34 is mounted and attached to a bolster 32 provided on the bed of the molding apparatus 10.

By lowering the slide 20, a molten metal or metal melt, or a semisolid slurry, or a semisolid preformed billet, that is arranged in a space in the lower die 38 can be compressed and worked to form a product.

Design is made of heat capacity of the lower die 34.

Also, so that a specific rate of solidification optionally selected may be had when the lower die and a material of the melt poured or teemed reach their thermal equilibrium state, a heat capacity of the lower die, a heat capacity of the metal melt being teemed and a latent heat thereof are calculate previously, and the size of the lower die, the melt temperature, the temperature of the lower die and the amount of the metal melt are designed so that a thermal balance may be taken at the specific rate of solidification.

When the temperature of the metal melt and the temperature of the lower die becomes equal to each other, it is thought that heat will no longer be transferred and the temperature will change no longer. A temperature $T_{eq}$ at that time (hereinafter, referred to as "equilibrium temperature") can be given below.

[mathematical expression 1]

$$T_{eq} = \frac{T_c + \gamma T_m + H'_f \ f_s}{1 + \gamma} \tag{1}$$

where $T_c$ is an initial temperature of the metal melt, $T_m$ is an initial temperature of the lower die, $H'_f$ is a semisolid latent heat divided by a specific heat, and $f_s$ is a rate of solidification. And, γ is a heat quantity required to raise a temperature of the lower die by 1 K, that is divided by a heat quantity required to raise a temperature of the metal melt by 1K, and is given below.

$$\gamma=(\rho_m c_m V_m)/(\rho_c c_c V_c) \tag{2}$$

where ρ is a density, c is a specific heat and V is a volume, and subscripts $_c$ and $_m$ represent the metal melt and lower die, respectively.

When a metal melt is teemed into the lower die, the melt is teemed from a height from the bottom of the lower die, which is 3.5 times or more of a mean diameter D of the lower die. Note, here, that the mean diameter is assumed to be the half (½) power of a product area of the lower die.

While product shapes do not matter, the lower die preferably has a flat base. The base if undulating should have a difference of undulation which is preferably not more than ½, and more preferably ¼, of the thickness of a product. Otherwise, a metal melt tends to accumulate on a lower portion, causing an unbalance in compressibility.

There is no specific limitation of a metal to be cast and forged according to the present invention. Especially, an alloy of low melting point such as an aluminum alloy is effective, however. Alloys of the Al—Si (ADC1) series, Al—Si—Mg (ADC3) series, Al—Si—Cu (ADC10, 10Z, ADC12, 12Z, ADC14) series and Al—Mg (ADC5, 6) series, prescribed by JIS, are suitably used.

Besides these aluminum alloys, such alloys as a magnesium alloy or a zinc alloy are similarly effective.

In general, the higher the rate of solidification, the less the fluidity, requiring higher pressure for injection, it being thought that it becomes harder to fill a thinner portion in the die.

It has been found, however, that a semisolid even if it is of high rate of solidification but if it is of grains having a reduced grain size is ensured of its fluidity and that one rather having a higher rate of solidification is allowed to fill a thinner portion reliably.

A rate of solidification of 30% or more is preferred. Noting that exceeding 60% increases the compression pressure, it has been found on the other hand that 60% or less is preferable.

A rate of cooling of the metal melt when it passes through the liquidus curve is preferably 2° C. per second or more.

A cooling rate not less than 2° C. per second is preferred. When the metal melt is cooled at a cooling rate of 20° C. per second or more, the semisolid will have extremely fine grains (having grain sizes of 2 to 4 μm) distributed therein. The existence of such micro grains is deemed to make it possible to produce a die cast product that is thin and which has substantially no gas entangled and no void left.

EXAMPLES OF EMBODIMENT

Example 1

In this Example, a connecting rod is produced.

Figure 2:
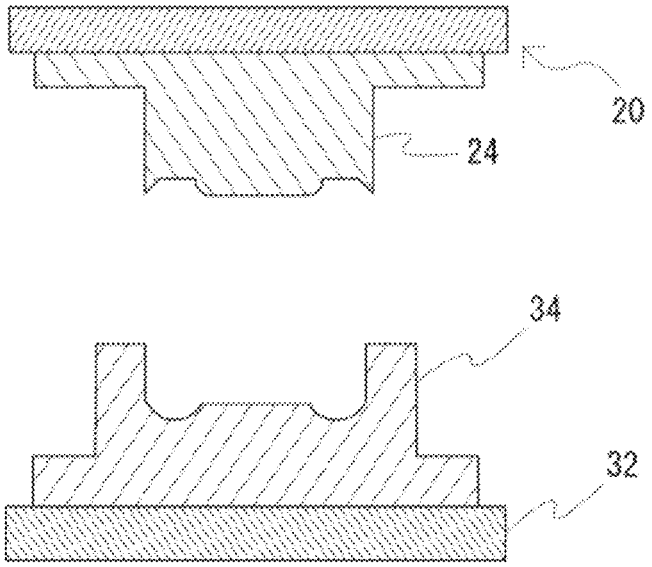
FIG. 2 is a view of a die (mold) arrangement illustrating a process step (before melt teeming) in Example 1 of the present invention.

As a mold or die, use is made of an upper die 24 and a lower die 34 as shown in FIG. 2.

Such that a semisolid slurry may be yielded having an adequate rate of solidification in the mold, optimum conditions are sought in advance, under which a semisolid casting and forging process is performed.

Figure 3:
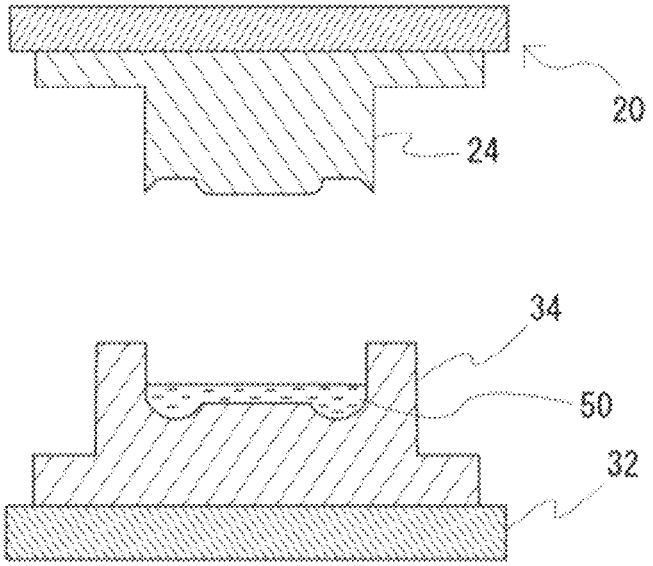
FIG. 3 is a view of a die arrangement illustrating a process step (for melt teeming) in Example 1 of the present invention.

The semisolid casting and forging process has process steps as follows:

1. Setting the temperatures of the metal melt and die;
2. Teeming into the lower die;
3. Movement towards the position at which the dies are to be clamped and closed;
4. Clamping and closing the dies;
5. Filling or packing;
6. Molding completed;
7. Opening the dies; and
8. Taking out a molded product As shown in FIG. 3, a molten metal or metal melt is teemed into a space in the lower die 34.

Figure 4:
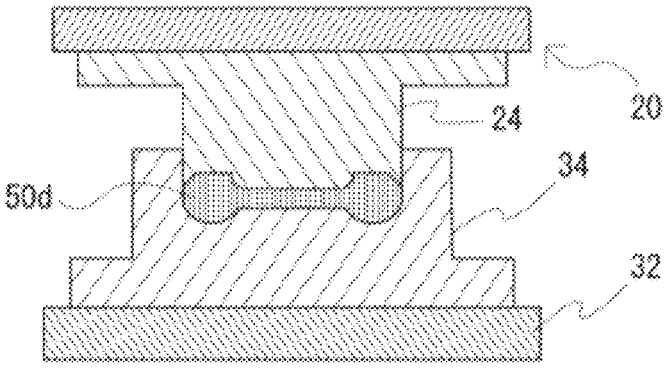
FIG. 4 is a view of a die arrangement illustrating a process step (for forging) in Example 1 of the present invention.

Subsequently, the upper die 24 as shown in FIG. 4 is lowered to compress a semisolid slurry and to form a product.

As the molding machine, use is made of a hydraulic servo-controlled press of 20 tons made by Kouei Seisakusho in which both the lower die (at the fixed side) 34 and the upper die (at the movable side) 24 are set at a temperature of 250° C. and the metal melt (AC4CH) is set at a temperature of 620° C.

The metal melt is teemed into the lower die 34 and the upper die 24 is lowered at a rate of movement of 0.1 m/s. The upper die 24 brought into contact with the semisolid slurry is moved as it is at the rate of movement of 0.1 m/s maintained to perform press molding.

A product **50*d*** after it is solidified is taken out from the dies.

Molding conditions are as follows:

Casting and Forging Conditions

Melt material: AC4CH

Liquidus temperature TL: 610-612° C.

Solidus temperature TS: 555° C.

Teeming temperature: 620° C.

Temperature of the upper die: 250° C.

Temperature of the lower die: 250° C.

Clamping rate: 0.1 m/s
Ratio of product mass/raw material mass: 0.9/1
Rate of solidification: 60%
Height of the melt in the lower die:
50 cm high from the cavity base in the lower die Example 2

In this Example, a product consisting of a composite is produced. Specifically, a connecting rod provided at each of its two ends with a ball 51 embedded therein as a different member.

Figure 5:
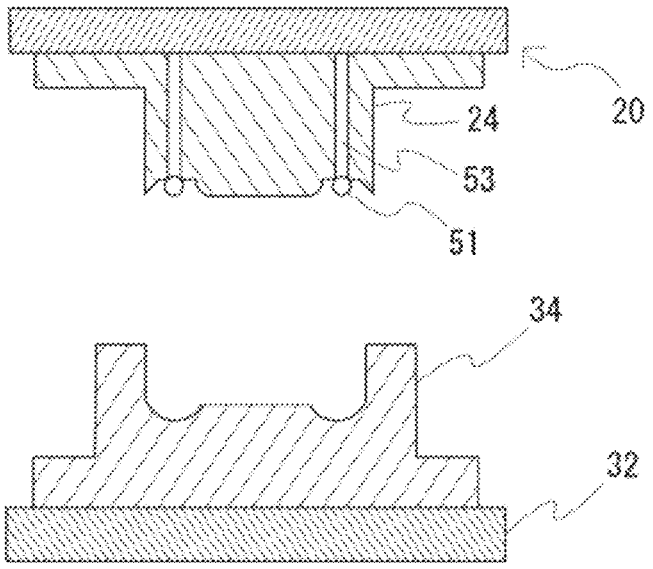
FIG. 5 is a view of a die (mold) arrangement illustrating a process step (before melt teeming) in Example 2 of the present invention.

In this Example as shown in FIG. 5, pin rods 53, each holding a ball 51, are inserted in the upper die 25. The balls 51 are held to the pin rods by magnetic force of attraction. A vacuum or any other chucking force may be substituted for.

Figure 6:
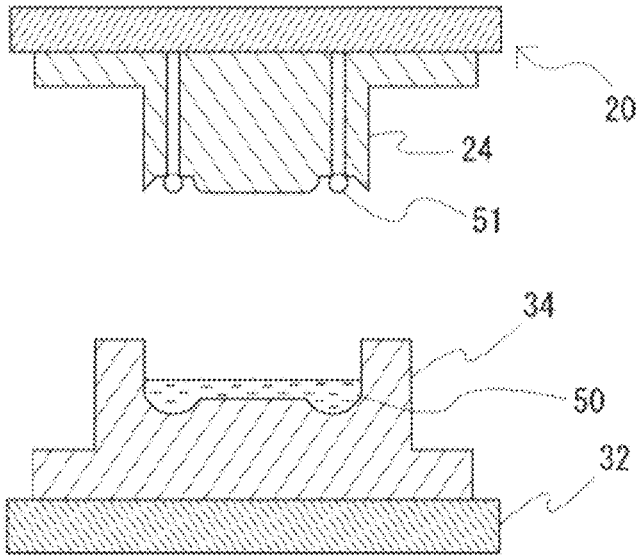
FIG. 6 is a view of a die (mold) arrangement illustrating a process step (before melt teeming) in Example 2 of the present invention.
Figure 7:
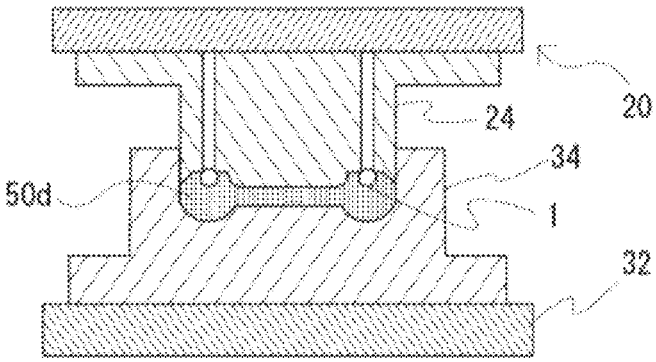
FIG. 7 is a view of a die arrangement illustrating a process step (for forging) in Example 2 of the present invention.

As in Example 1, a metal melt is teemed (FIG. 6). Then, the upper die 24 is lowered. The balls 51 are lowered with the upper die 34 lowered and come to be embedded in the semisolid slurry (FIG. 7). Each of the balls 51 is solidified and left at the product side. Then, more than one half of the ball body is left embedded in the body of the product. The ball having a diameter more than a diameter of its entry or exposed portion could not leave the body. When a member of a shape other than a ball is to be embedded in a body of the product, the member suitably bent will prevent it from leaving the body.

Thus, according to the present invention, a member that can be of an intricate shape can be embedded in a body (semisolid slurry) of the product, making it possible to mold a composite member with a firm bond acquired without resort to welding or the like.

Figure 8:
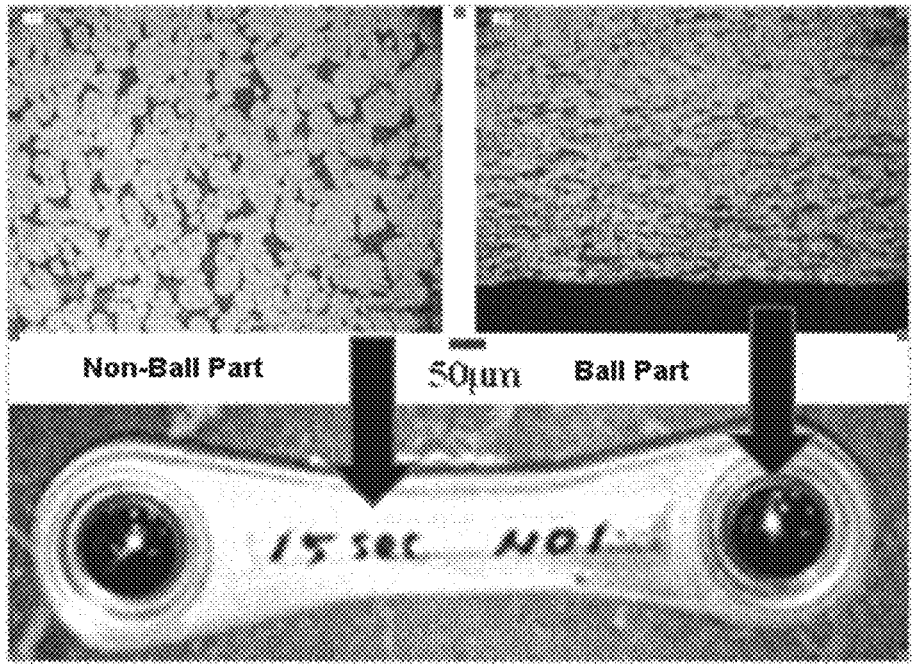
FIG. 8 carries photographs showing a view of metallurgical structure and a view of appearance of a product, using the forming apparatus shown, and formed in Example 2 by the method, of the present invention.
Figure 9:
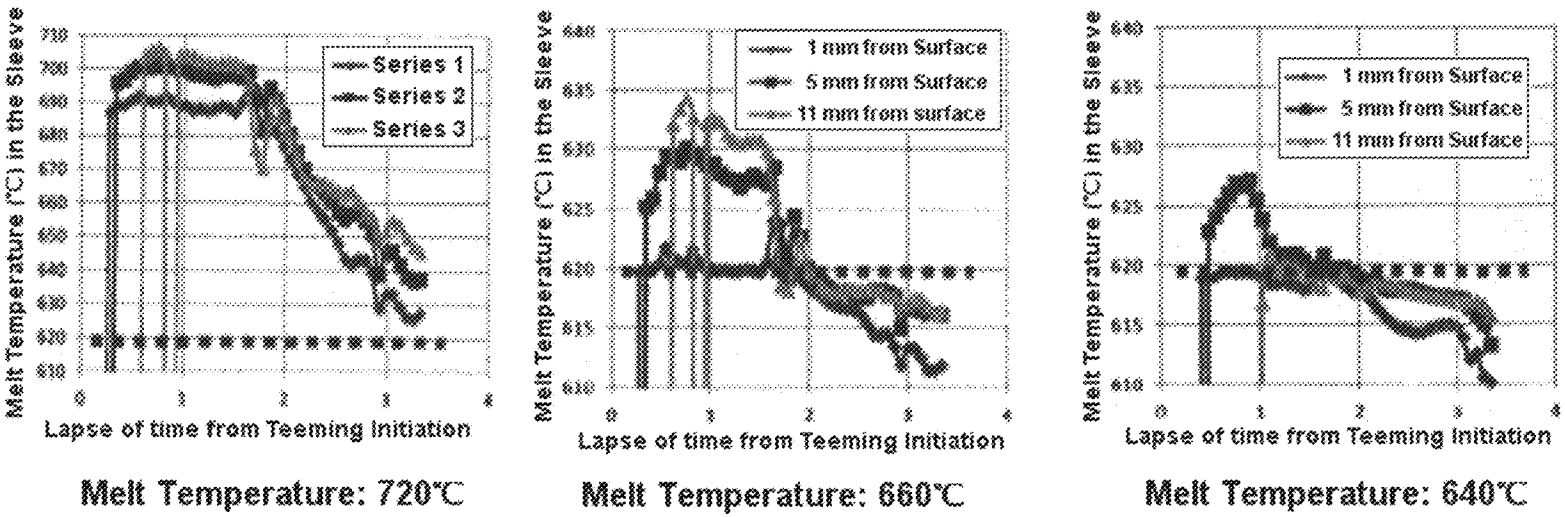
FIG. 9 carries graphs illustrating influences exerted by a teeming temperature on a uniformity of thermal distribution of a semisolid slurry.

FIG. 8 shows a photograph of appearance of a semisolid molded product (connecting rod) and results of observation of its metallographic structure. It has primary crystals a which as those by the conventional semisolid slurry method (NRC, NRF, nano-cast, cup and sleeve techniques) are seen to include ones have a variation and a little unstable in size. But, the structure is found to possess a spherical structure having an average grain size of about 50 μm throughout the entirety of a molded product. As a result, the product is excellent having substantially no shrinkage void and no segregation therein.

The spherical crystallographic structure having crystal grains of an average grain size around 50 μm in a final product has a grain size smaller than that in its semisolid slurry stage.

A plastic flow has been observed in a high load portion (ball part) of the connecting rod and deemed to form a microstructure expected of an increased strength. To wit, such a portion at it is not only under a high load but also at a low temperature is deemed to solidify and bring about a plastic deformation that provides a forged structure.

Thus, in the present invention, there can be formed a forged structure in a cast structure.

INDUSTRIAL APPLICABILITY

According to the present invention, an excellent cast product can be made having a microstructure and in which there is substantially no shrinkage void and substantially no non-metallic inclusion and which may not only be a thin but also a thick product. Accordingly, the present invention can be utilized not only in the field of electrical and electronic components but only in those, e.g. that of automobile components and others.

The present invention is applicable to all possible shapes of articles other than that of a connecting rod, including, for example, a member H-shaped in cross section, a member I-shaped in cross section, a member in the shape of a kettle or iron pot, a member in the shape of a cross, an aluminum wheel and other products. The applicable industrial field is thus not limited to a particular field of industry.

What is claimed is:

1. A semisolid melt casting and forging method, comprising:

teeming a metal melt into a cavity of a lower die, and moving at least one of the lower and an upper die relatively towards the other at a rate of movement to perform molding of the metal melt in a semisolid state;

wherein said metal melt is formed into a slurry having grains of a grain size of not more than 50 μm throughout the slurry, and wherein said molding is initiated at a lapse of time ranging between 0.1 second and 10 seconds following an instant at which the metal melt is teemed.

2. A semisolid melt casting and forging method as set forth in claim 1 wherein said lapse of time between the instant at which the metal melt is teemed and the instant at which the molding is initiated is between 0.1 second and 5 seconds.

3. A semisolid melt casting and forging method, comprising the steps of:

teeming a metal melt so that it is supercooled to be teemed into a lower die in a press so controlled that the metal melt has a rate of solidification as desired, so as to make a semisolid slurry having crystal grains of a grain size of not more than 50 μm throughout;

bringing at least an upper die into contact with the semisolid slurry; and thereafter moving at least one of the upper and lower dies relatively towards the other at a rate of movement between 0.1 and 1.5 meter per second at least after an instant at which the upper die comes in contact with said semisolid slurry, thereby compressing said semisolid slurry to mold it into a product.

4. A semisolid melt casting and forging method as set forth in claim 1, wherein the metal melt as it is teemed is of a temperature higher by 10 to 30° C. than its liquid phase or liquidus temperature.

5. A semisolid melt casting and forging method as set forth in claim 1, wherein the metal melt is cooled passing through a liquidus curve at a rate of cooling of not less than 2° C. per second.

6. A semisolid melt casting and forging method as set forth in claim 1, wherein said lower die is of a temperature of 200° C.±100° C.

7. A semisolid melt casting and forging method as set forth in claim 1, wherein said upper die is of a temperature different from that of said lower die.

8. A semisolid melt casting and forging method as set forth in claim 7, wherein the temperature of at least a portion of said upper die is lower than the temperature of said lower die.

9. A semisolid melt casting and forging method as set forth in claim 1, wherein the ratio in mass of a product to a raw material is not less than 0.9.

* * * * *